United States Patent [19]

Wright

[11] Patent Number: 4,643,423

[45] Date of Patent: Feb. 17, 1987

[54] PITCHING TARGET

[76] Inventor: Robert L. Wright, 4221 - 75th St., Des Moines, Iowa 50322

[21] Appl. No.: 666,689

[22] Filed: Oct. 31, 1984

[51] Int. Cl.[4] ..... A63B 69/00

[52] U.S. Cl. ..... 273/26 A; 273/181 F

[58] Field of Search ..... 119/61, 68; 273/30, 273/29 A

[56] References Cited

U.S. PATENT DOCUMENTS

| | | | |
|---|---|---|---|
| 400,080 | 3/1889 | Harder | 119/68 |
| 1,511,430 | 10/1924 | Schonberg | 273/26 A |
| 1,567,384 | 12/1925 | Rectenwald et al. | 273/26 A |
| 2,040,228 | 5/1936 | Whiteley | 273/26 A |
| 2,657,058 | 10/1953 | Mulcahy | 273/26 A |
| 2,839,300 | 6/1958 | Blaha | 273/26 A |
| 2,895,737 | 7/1959 | Blees | 273/26 A |
| 3,197,208 | 7/1965 | Makar | 273/26 A |
| 3,227,449 | 1/1966 | Schwab | 273/181 F |
| 3,704,849 | 12/1972 | Green | 272/62 |
| 3,918,711 | 11/1975 | Zak | 273/26 A |
| 4,063,739 | 12/1977 | LaRose | 273/181 F |
| 4,203,413 | 5/1980 | Hodges | 273/29 A |
| 4,204,677 | 5/1980 | Haggarty | 273/26 A |
| 4,239,235 | 12/1980 | Torres | 273/29 A |
| 4,415,154 | 11/1983 | Englehardt | 273/26 A |

FOREIGN PATENT DOCUMENTS

| | | | |
|---|---|---|---|
| 3033442 | 4/1982 | Fed. Rep. of Germany | 273/30 |
| 26757 | of 1901 | United Kingdom | 273/30 |

*Primary Examiner*—Anton O. Oechsle
*Assistant Examiner*—T. Brown
*Attorney, Agent, or Firm*—Zarley, McKee, Thomte, Voorhees & Sease

[57] ABSTRACT

A pitching target is provided and includes a self-supporting frame having an elongated top crossbar supported above a support surface by legs at each end of the crossbar. A screen having a strike zone depicted thereon is attached to the crossbar so as to hang freely therefrom. A trough is positioned beneath the screen so as to receive balls impacting on the screen falling downwardly therefrom.

6 Claims, 6 Drawing Figures

PITCHING TARGET

BACKGROUND OF THE INVENTION

Many different types of pitching targets have been used in the past for training and practice by baseball and softball pitchers. Simple targets include walls or fences with strike zones depicted thereon. However, balls are easily damaged by the impact upon such rigid surfaces. Other targets are constructed from tires or other material having an opening therein through which the ball is pitched. These open targets oftentimes included a bag attached behind the opening to catch the balls. Thus, the balls are retrieved from behind the target or from the bag, a procedure which is time consuming or awkward. Other targets consist of canvas or similar material stretched on a frame. These type of targets tend to sling the ball back toward the pitcher or otherwise away from the target due to the trampoline effect of the stretched material.

Therefore, a primary objective of the present invention is the provision of an improved pitching target for baseball and softball pitchers.

A further objective of the present invention is the provision of an improved pitching target which stops the pitched balls without damage thereto.

Another objective of the present invention is the provision of a pitching target which has a trough for holding a plurality of balls which are stopped by the target.

Still another objective of the present invention is the provision of a pitching target which is self-supporting.

A further objective of the present invention is the provision of a pitching target having a free swinging screen for absorbing the shock and energy of pitched balls.

Another objective of the present invention is the provision of a pitching target which prevents low pitches from rolling beneath the target.

A further objective of the present invention is the provision of a pitching target which is economical to manufacture and durable in use.

SUMMARY OF THE INVENTION

The pitching target of the present invention includes a frame comprised of an elongated top crossbar supported at opposite ends by a pair of diverging legs. A screen having a strike zone depicted thereon is secured to the crossbar so as to hang freely therefrom. A trough is secured to the legs so as to be positioned beneath the screen whereby balls impacting upon the screen fall downwardly therefrom and into the trough. The lower edge of the screen extends into the trough and is weighted so as to limit the reaction of the screen to the impact of a pitched ball.

DETAILED DESCRIPTION OF THE DRAWINGS

Figure 1:
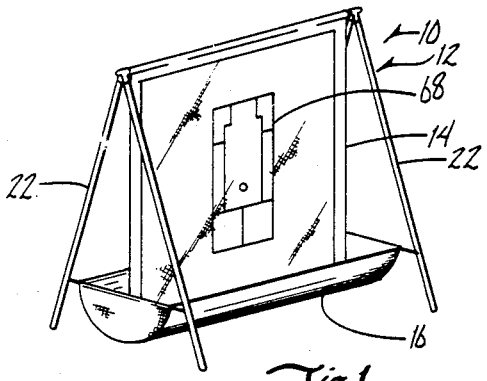
FIG. 1 is a perspective view of the pitching target of the present invention.
Figure 2:
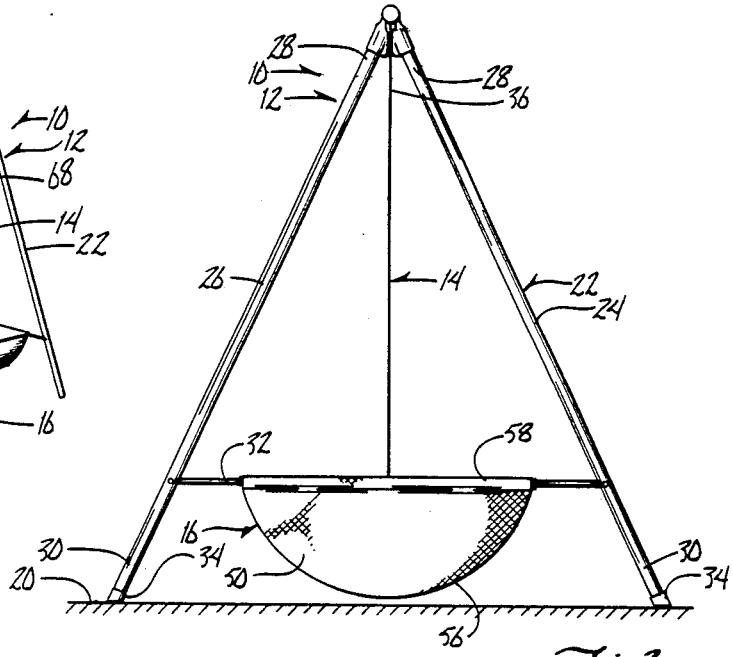
FIG. 2 is a side elevational view of the pitching target.

The pitching target of the present invention is generally depicted in the drawings by the reference numeral 10. Target 10 basically includes a frame 12, a screen 14 attached to frame 12 so as to hang freely therefrom, and a trough 16 positioned beneath screen 14 to catch balls which impact upon screen 14 and fall downwardly therefrom.

More particularly, frame 12 includes an elongated top crossbar 18 supported above a support surface 20 by a pair of leg means 22. Each leg means 22 includes an elongated front leg 24 and an elongated back leg 26. The upper ends 28 of front and back legs 24 and 26 are positioned adjacent to one another to support crossbar 18 while the lower ends 30 of legs 24 and 26 are spaced apart such that each leg means 22 forms an A-frame. Each leg means 22 may also include a brace member 32 extending between front leg 24 and back leg 26 intermediate upper ends 28 and lower ends 30 thereof for structural support. Also, lower ends 30 of legs 24 and 26 may have a cap thereon to prevent marring of support surface 20 by target 10.

Screen 14 includes an upper edge 36, a lower edge 38, and opposite sides 40 and 42. Upper edge 36 of screen 14 includes a heading or open ended pocket 44 through which crossbar 18 extends to support screen 14 in a free hanging manner. While this construction is the preferred attachment of screen 14 to frame 12, it is understood that upper edge 36 of screen 14 may be secured to frame 12 in any convenient manner without departing from the scope of the present invention. It is also understood that screen 14 can be attached to a ceiling or other structure so as to be supported only at upper edge 36 and so that the screen is free to swing.

Figure 5:
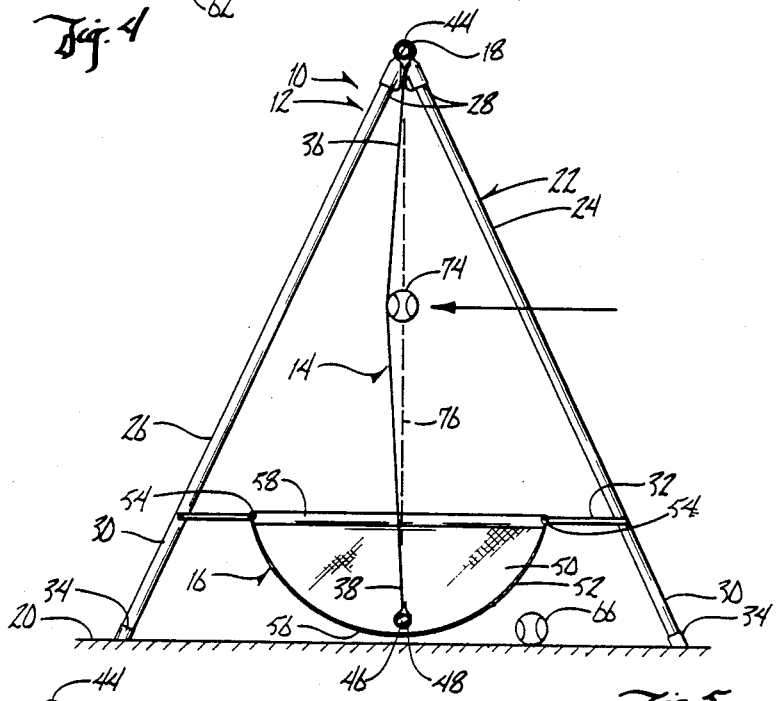
FIG. 5 is a sectional view taken along lines 5—5 of FIG. 3 and showing the reaction of the screen to a pitched ball.
Figure 6:
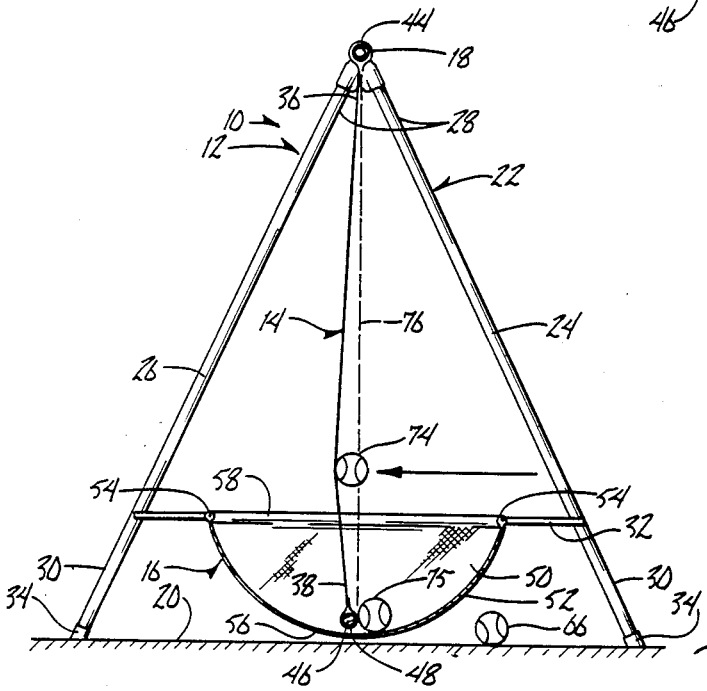
FIG. 6 is a view similar to FIG. 5.

A weight 46 is secured to lower edge 38 of flexible screen 14 so as to limit the reaction of the screen caused by the impact of a ball thereon. As seen in FIGS. 5 and 6, lower edge 38 preferably has a heading or open ended pocket 48 for housing weight 46.

Figure 4:
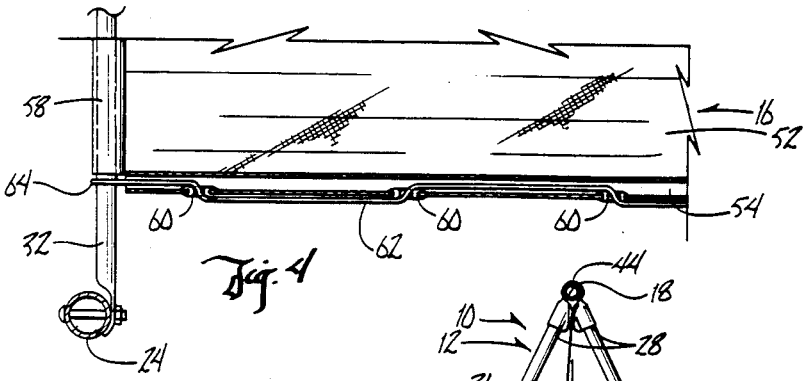
FIG. 4 is a sectional view taken along lines 4—4 of FIG. 3.

Trough 16 includes semi-circular opposite ends 50 and a rectangular portion 52 attached to ends 50 such that trough 16 has a semi-cylindrical or arcuate shape with an upper edge 54 and a bottom portion 56. In the preferred embodiment, each end 50 of trough 16 has an open ended pocket or heading 58 through which brace member 32 extends to support trough 16 on frame 12. Trough 16 may include, in the alternative or in addition, a plurality of grommets 60 along at least a portion of upper edge 54 through which a tension member 62 such as cable or rope may be threaded such that the opposite ends 64 of tension member 62 can be secured to frame 12 to support trough 16 thereon, as best seen in FIG. 4. It is understood that trough 16 can be secured to frame 12 in any other convenient manner without departing from the scope of the present invention.

As seen in FIGS. 5 and 6, trough 16 is positioned beneath screen 14 such that the lower edge 38 of screen 14 extends into the trough and is free to swing therein. Also, bottom portion 56 of trough 16 is sufficiently close to support surface 20 to prevent a ball 66 from rolling thereunder.

Figure 3:
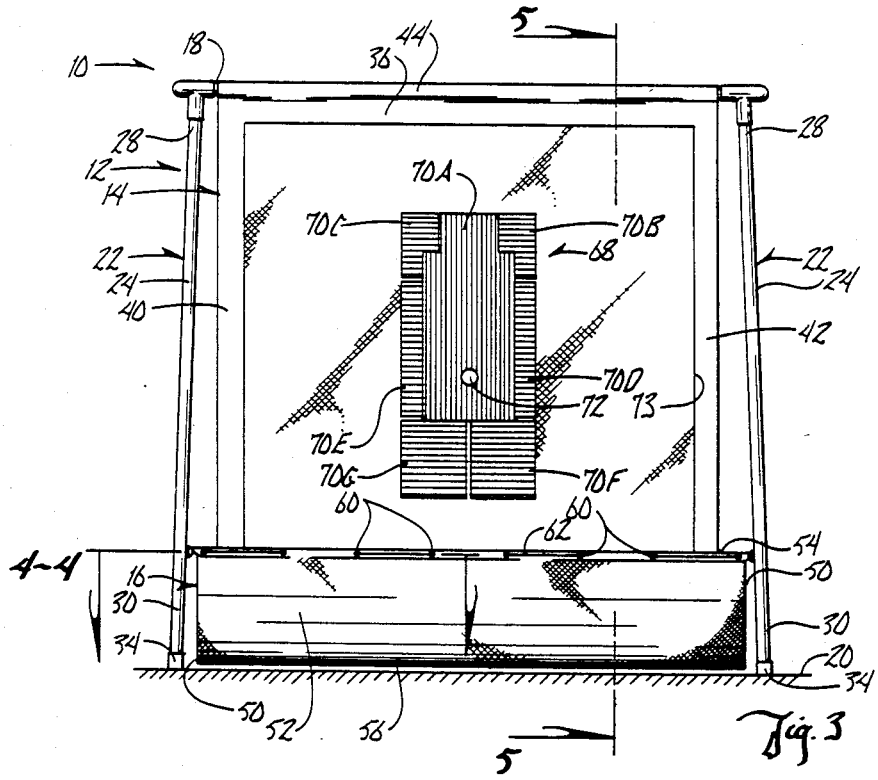
FIG. 3 is a front elevational view of the pitching target.

A strike zone 68 is depicted on screen 14 and may be divided into a plurality of color-coded sections 70A–70G, as seen in FIG. 3, indicating preferred location of a pitched ball within the strike zone. A ball outline 72 may also be depicted on strike zone 68. The portion of screen 14 surrounding strike zone 68 is preferably white in color while a border 73 of contrasting color is provided on screen 14.

With reference to FIGS. 5 and 6, it is seen that screen 14 is flexible so as to absorb the shock and energy of a pitched ball 74. Before ball 74 hits screen 14, the screen hangs freely as indicated by dotted line 76 from crossbar 18. Screen 14 moves rearwardly in reaction to the force of pitched ball 74. The weighted lower edge 38 of screen 14 limits such reaction of the screen to the impact of the ball such that the lower edge is always maintained within trough 16. As pitched ball 74 is stopped by screen 14, the ball drops downwardly therefrom for storage in trough 16, as indicated by ball 75. As seen in FIGS. 5 and 6, lower edge 38 of screen 14 is sufficiently close to bottom portion 56 of trough 16 to prevent balls from rolling beneath the lower edge of screen 14. Thus, the balls are stored within the forward side of trough 16 for easy retrieval therefrom.

Preferably frame 12 is constructed of lightweight PVC pipe which also acts to absorb some shock from the force of a pitched ball. Screen 14 is preferably constructed of polyester coated reinforced vinyl with strike zone 68 being sewn or silk screened upon the vinyl. The coloring of screen 14 tends to force a pitcher to focus his or her eyes upon strike zone 68. While the size of a strike zone in a game situation varies from batter to batter, the width of the strike zone never varies.

Thus, pitching target 10 of the present invention accomplishes at least all of the stated objectives.

What is claimed is:

1. A free-standing baseball and softball pitching target comprising:

a frame having an elongated top crossbar supported above a support surface by leg means at each end of said crossbar, a screen having a flat front surface secured to said crossbar so as to hand and swing freely therefrom in a planar fashion and having a target depicted on said flat front surface, a stationary trough mounted on said frame in a fixed position beneath said screen for receiving balls impacting on said screen and falling downwardly therefrom, said trough being positioned sufficiently close to said support surface to prevent balls from rolling beneath said trough, said lower edge of said screen being free and independent of said frame and trough, and said screen having upper and lower edges and opposite sides, said lower edge extending into said trough so as to define a front portion and back portion of said trough, whereby balls impacting on said screen drop downwardly therefrom and are collected in said front portion of said trough, said screen freely swinging independently and relative to said trough in response to impact of said ball and said lower edge of said screen being in closely spaced proximity to the bottom of said trough.

2. The target of claim 1 further including weight means on said lower edge of said screen for limiting the reaction of said screen upon impact by a ball.

3. The target of claim 1 wherein said trough is arcuately shaped in cross-section such that said lower edge of said screen remains in close proximity to the bottom of said tough when said screen moves in response to impact by a ball.

4. The target of claim 1 wherein each of said leg means includes a pair of legs diverging from said crossbar in opposite directions, and a brace member extending between each of said pair of legs.

5. The target of claim 4 wherein said trough has opposite ends secured to said brace members.

6. The target of claim 1 wherein said target on said screen is a strike zone area which is subdivided into color coded segments corresponding to preferred locations for a pitched ball.

* * * * *